United States Patent [19]

Grieve et al.

[11] 4,208,270

[45] Jun. 17, 1980

[54] HYDROCYCLONE ASSEMBLY

[75] Inventors: Donald F. Grieve, La Honda; Robert E. Hochscheid, Palo Alto, both of Calif.

[73] Assignee: Krebs Engineers, Menlo Park, Calif.

[21] Appl. No.: 36,386

[22] Filed: May 7, 1979

Related U.S. Application Data

[63] Continuation of Ser. No. 890,406, Mar. 27, 1978, abandoned.

[51] Int. Cl.[2] ..... B04C 5/20

[52] U.S. Cl. ..... 209/211; 210/512 M; 55/267; 151/38; 165/82; 285/187; 285/137 R

[58] Field of Search ..... 210/512 R, 512 M; 209/211, 144; 55/346, 349, 348, 459 R, 267; 85/50 R; 151/38; 165/81, 82, 134; 285/187, 137 R, 340, DIG. 5

[56] References Cited

U.S. PATENT DOCUMENTS

| | | | |
|---|---|---|---|
| 2,461,677 | 2/1949 | Burdock et al. | 55/348 |
| 2,464,152 | 3/1949 | Ralston | 151/38 X |
| 2,622,735 | 12/1952 | Criner | 209/211 |
| 2,765,918 | 10/1956 | Fontein et al. | 209/211 X |
| 3,371,794 | 3/1968 | Johnson | 210/512 M |
| 3,815,635 | 6/1974 | Jansen | 151/38 X |

OTHER PUBLICATIONS

"Krebs Multicone Model 10-1295" Parts List Krebs Engineers, Menlo Park, Ca. Jun. 18, 1973.

*Primary Examiner*—Ralph J. Hill

*Attorney, Agent, or Firm*—Flehr, Hohbach, Test, Albritton & Herbert

[57] ABSTRACT

A hydrocyclone assembly suitable for use with high temperature feeds (e.g., hot petroleum liquids). The hydrocyclone body is made of ceramic material with one end being flanged and cooperating with an inlet head. These parts are clamped against a mounting plate by means including one or more spring members of the distorted washer type (e.g., Belleville washer). The mounting minimizes breakage of the hydrocyclone body when used with high temperature fluid feed. Some embodiments employ a plurality of hydrocyclones disposed within a common pressure vessel.

6 Claims, 9 Drawing Figures

HYDROCYCLONE ASSEMBLY

This is a continuation, of application Ser. No. 890,406 filed Mar. 27, 1978 now abandoned.

BACKGROUND OF THE INVENTION

This invention relates generally to hydrocyclone assemblies such as are employed with fluid feeds for removing solid particulate material. More specifically, it relates to hydrocyclone assemblies suitable for application to high temperature fluid feeds.

Hydrocyclones are widely employed in various industries for separating operations. Thus they may be used for removal of undesired particular material from liquids, dewatering or concentrating operations, or for classification of solids. Many hydrocyclones are made of suitable metal with an inner liner made of material which resists erosion, such as a synthetic rubber or elastomer, or a ceramic material. For certain services, such as where the fluid feed is at an elevated temperature, the hydrocyclone may be made entirely of ceramic material. The mounting of such ceramic hydrocyclones has presented certain problems, particularly when one or more ceramic hydrocyclones are assembled within a pressure vessel. High temperatures (e.g., 700° to 800° F.) and rapid changes in temperature tend to cause development of leakage between the assembled parts, and localized stressing of the ceramic material to the point of causing breakage. Such temperatures and rapid temperature changes are experienced in the petroleum refining industry during the processing of certain petroleum products. A hydrocyclone failure during such processing operations may necessitate shutting down an entire processing system while making repairs.

Multicyclone assemblies as previously manufactured and sold by the assignee of this application, and certain assemblies made by others, have been subject to additional objectionable features. The upright cyclones of such assemblies are disposed between two vertically spaced plates, with the space between the plates forming a feed chamber into which the feed is introduced. The overflow and underflow materials discharge into the spaces above the upper and below the lower plate, respectively. The velocity of the incoming feed is relatively low with the result that solids tend to build up as a stagnant mass in the feed chamber. The accumulated solids may be of such character that they tend to compact and form agglomerates with the result that lumps may break off and plug the feed passages to the cyclone chambers, and what is more serious, may cause plugging of the cyclone underflow apex orifice or the overflow vortex finder.

OBJECTS OF THE INVENTION AND SUMMARY

It is an object of the invention to provide a hydrocyclone assembly which utilizes one or more hydrocyclones made of ceramic material, with the hydrocyclone mounting being such that it is capable of operating at relatively high temperatures and under rapid temperature changes, without occasioning undue stressing of the ceramic material with possible breakage.

Another object is to provide a hydrocyclone assembly making use of a pressure vessel within which the ceramic hydrocyclone or hydrocyclones are mounted.

Another object is to provide a multicyclone assembly which largely avoids the clogging difficulties of prior art assemblies as previously described and which is characterized by location of the feed chamber above the hydrocyclones.

Another object is to provide a hydrocyclone assembly unit which can be readily manifolded with other such units.

In general, the present invention consists of a hydrocyclone body of ceramic material having an elongated separating chamber, with one end of the body having an integral flange. That portion of the chamber near the flanged end serves to receive feed material, and an extended conical portion of the chamber communicates at its apex end with an underflow discharge opening. The hydrocyclone includes an inlet head having one side of the same in abutting engagement with the flanged end of the body. A mounting plate is provided for carrying the hydrocyclone, and one side of the plate is in abutting engagement with the inlet head. The inlet head has an overflow passage communicating axially with the interior of the chamber, and an involute passage having its outlet end communicating tangentially with the separating chamber. Means is provided on the other side of the mounting plate which forms separate fluid feed receiving and overflow receiving spaces. The mounting plate has one duct for establishing fluid communication between the feed receiving space and the inlet end of the involute passage, and another duct for establishing fluid communication between the overflow receiving space and the overflow passage. The flanged end of the body and the inlet head are clamped together and against the mounting plate by yieldable means including a spring of the distorted washer type. Also the invention includes assemblies which employ a plurality of such hydrocyclones, each mounted as described above and with the hydrocyclones enclosed within a pressure vessel. A plurality of such hydrocyclone assemblies can be manifolded by a simple manifolding arrangement.

Additional objects and features of the invention will appear from the following description in which the preferred embodiments have been set forth in detail in conjunction with the accompanying drawing.

DESCRIPTION OF THE PREFERRED EMBODIMENTS

Figure 1:
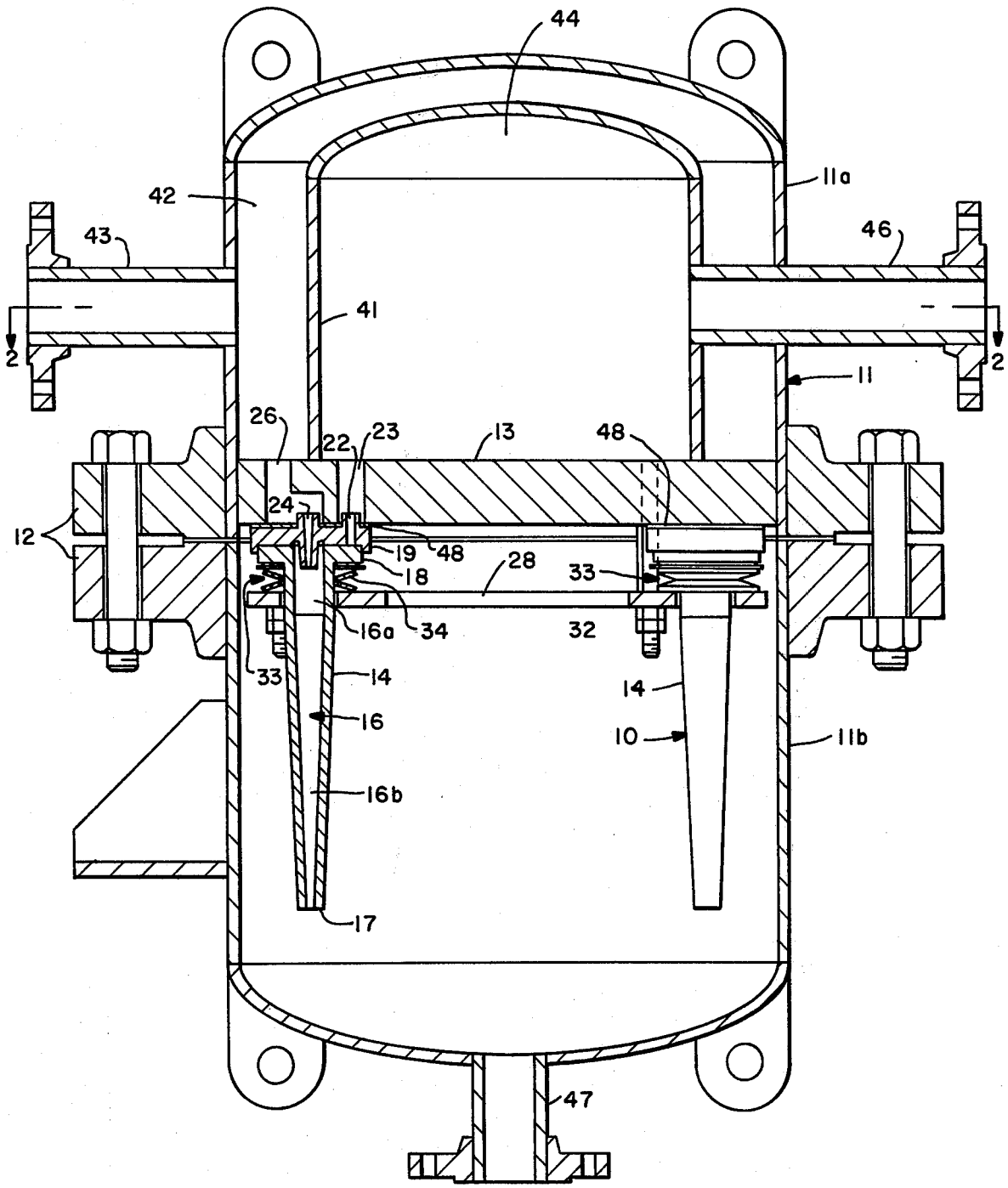
FIG. 1 is a side elevational view in section illustrating a hydrocyclone assembly incorporating the present invention.
Figure 2:
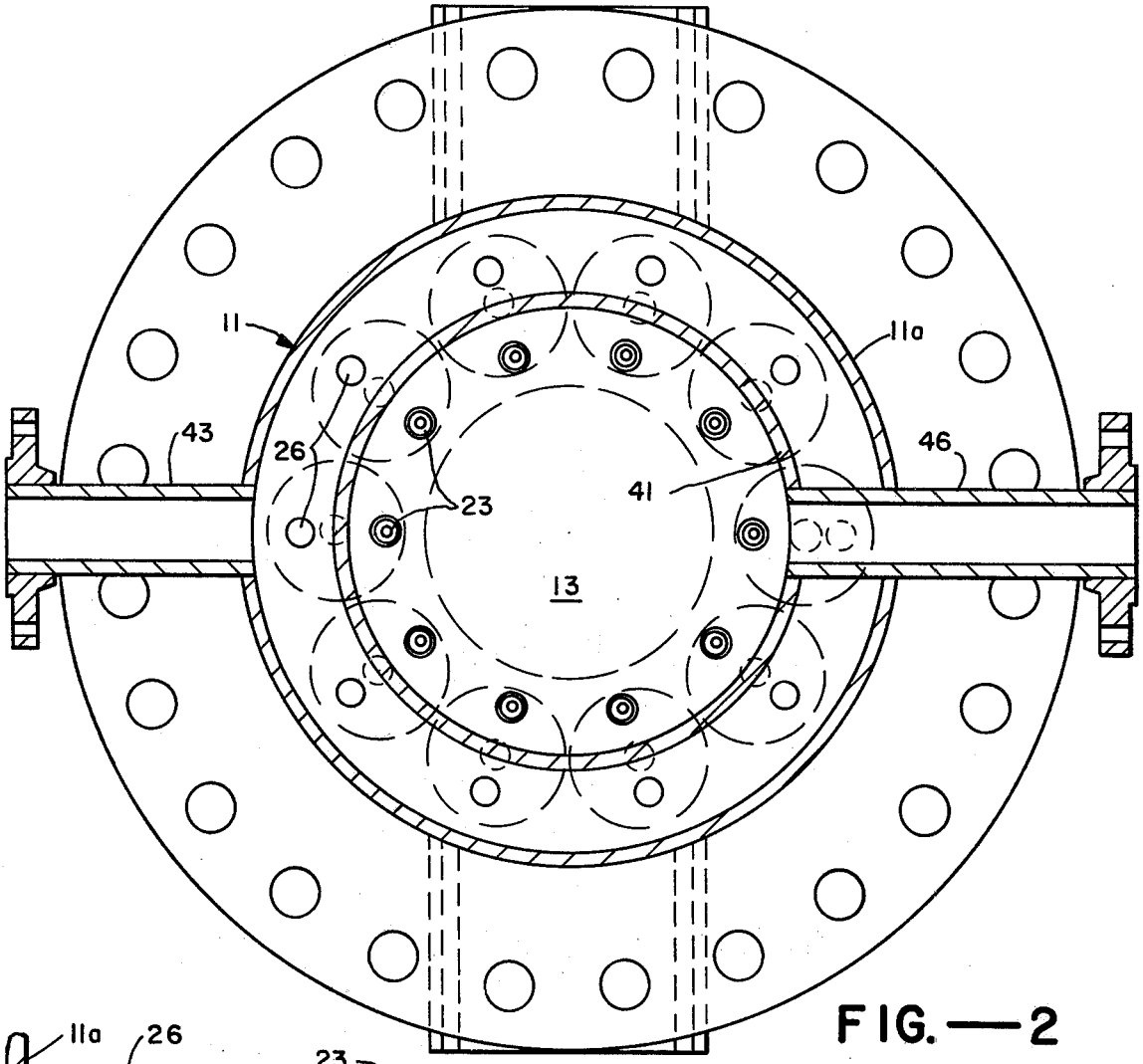
FIG. 2 is a cross-sectional view taken along the line 2—2 of FIG. 1.
Figure 4:
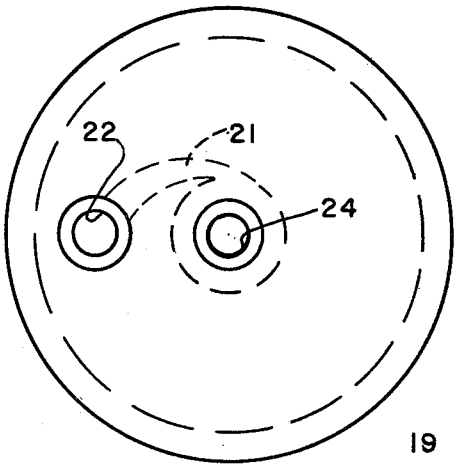
FIG. 4 is a plan view on the same scale as FIG. 3 showing the inlet head of the cyclone.

The assembly shown in FIGS. 1 and 2 consists of a plurality of hydrocyclones 10, all disposed within a common pressure vessel 11. This vessel is shown in two sections 11*a* and 11*b* which are secured together by the bolted coupling flanges 12. The mounting means for the hydrocyclones consists of a plate 13 which is circular and which has sealed engagement with the upper vessel section 11*a*. Each of the hydrocyclones consists of a body 14 formed of ceramic material and formed to provide the inner elongated separating chamber 16. The upper portion 16*a* of the separating chamber receives the feed material, and the extended conical portion 16*b* terminates at the apex underflow opening 17. The ceramic body is provided with an integral annular flange 18, and seated upon the corresponding end of the body there is an inlet head 19 which likewise can be made of ceramic material. FIG. 4 is a plan view of this head. Its lower side is provided with a channel 21 forming an involute flow passage. The inlet end of this flow passage communicates with the duct 22 in the head, and this duct communicates with the duct 23 in the mounting plate 13. The inner end of the involute passage 21 communicates tangentially with the upper part of the separating chamber. The inlet head is also provided with a centrally located duct 24, the lower end of which communicates axially with the separating chamber. The upper end of the flow passage 24 is in communication with the duct 26 of the mounting plate 13.

Figure 3:
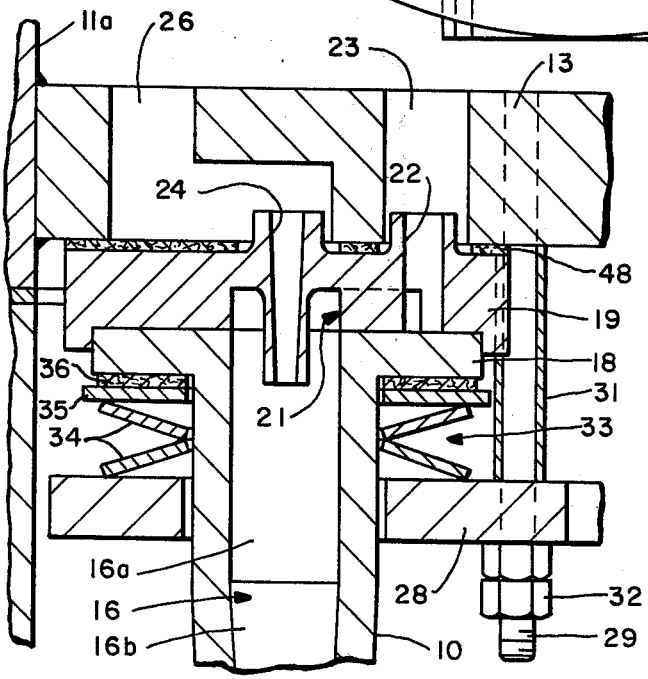
FIG. 3 is an enlarged detail in section showing the manner in which a hydrocyclone is mounted.

The means employed for clamping the upper end of the hydrocyclone body against the inlet head and the mounting plate 13 is shown in FIGS. 1 and 3. It consists of an abutment member 28 which in this instance is in the form of an annular plate. It is mounted in spaced parallel relationship with the lower side of the plate 13 by the bolts or rods 29. Tubular spacers 31 serve to maintain the desired spacing between the plate 13 and the abutment member 28. Normally the abutment member 28 is clamped against the spacer 31 by nuts 32. Yieldable thrust means 33 of the distorted spring washer type is interposed between the abutment member 28 and the lower side of the flange 18. As illustrated, this consists of two spring washers 34 of the Belleville type which are dished in opposite directions and which are sufficiently compressed to exert the desired upward force upon the flange 18. This force must be sufficient to exceed the normal downward force upon the inlet head 19 exerted by virtue of fluid pressure differential being applied to the head through the ducts 26 and 23. Additional flat washers 35 and 36 are interposed between the upper Belleveville washers 34 and the lower side of the ceramic flange. In practice it has been found desirable for washer 35 to be made of metal and washer 36 of non-metallic material that will yield somewhat in compression, such as asbestos. The Belleville washers are made of a suitable metal alloy capable of retaining its elasticity under high temperatures, such as Inconel, which is a nickel-chromium alloy.

As shown in FIG. 2 the hydrocyclones are arranged in a circle below the plate 13. A vent 26 is provided for each hydrocyclone, and these vents are arranged in a circle. Similarly, a duct 23 is provided for each hydrocyclone and they are arranged in a circle. In the event it is found desirable to change the thrust applied by the Belleville washers 34, spacing tubes 31 of different length may be applied about the rods 29, thus adjusting the spacing between the abutment member 28 and the lower side of the mounting plate 13.

The interior of the pressure vessel section 11*a* is provided with means serving to divided the interior of the same into two spaces, namely a feed receiving space and an overflow receiving space. Thus a dome-shaped member 41 is secured to the upper side of the mounting plate 13 and has a configuration similar to the configuration of the outer walls of vessel section 11*a*. The space 42 surrounding the dome member 41 forms the overflow receiving chamber and is in communication with the ducts 26. Overflow is discharged from the space 42 through the pipe 43. The space 44 within the dome member 41 forms the feed receiving space and communicates with the feed pipe 46. It delivers feed under pressure to the ducts 23.

The lower section 11*b* of the pressure vessel is provided with the discharge pipe 47 for the discharge of underflow material.

The engagement between the end of each hydrocyclone body and the inlet head 19, and also the engagement between the inlet head and the lower side of the mounting plate 13, should be such as to prevent leakage under the applied working pressures and the pressure differential between the feed pressure and the pressure in the vessel section 11*b*. In this connection it has been found desirable to employ lapped surfaces between the hydrocyclone body and the head 19, thus effecting a good fluid-tight seal without the use of gasket or other sealing means. With respect to the engagement between the upper side of the inlet head 19 and the lower side of the mounting plate 13, it has been found desirable to employ a gasket capable of withstanding the temperatures and pressures to which the assembly is subjected, such as a gasket of the asbestos type.

Assuming that the assembly shown in FIGS. 1–4 is in operation with hot petroleum liquid being supplied through the pipe 46, the liquid is forced through the ducts 23 in the mounting plate 13, and from thence through the involute passages 21 to the separating chamber of each of the hydrocyclones. As is well known to those familiar with the operation of hydrocyclones, the swirling movement of material within the separating chamber 16 causes heavier particulate material to be separated by centrifugal action whereby heavier separated material discharges in an underflow through the opening 17, and lighter overflow discharges through the passage 24 and duct 26. The overflow discharges from the space 42 through the outlet pipe 43, and the underflow is discharged through pipe 47. The fluid pressure area presented by the inlet head 19 is such that for the differential fluid pressure applied, the head remains secured firmly against the mounting plate and against the adjacent end of the hydrocyclone body to prevent leakage. Assuming that the assembly is at ambient temperature and the hot liquid feed applied as in a start-up operation, there is necessarily a rapid change in temperature of all of the parts which causes rapid expansion of the parts under clamping pressure. Such changes are accommodated by the yielding thrust applied by the Belleville washers 34. In addition, the Belleville washers acting through flat washers 35 and 36 apply relatively evenly distributed pressure to the underside of the ceramic flange 18, whereby stressing of this flange under operating pressures is essentially distributed evenly over the flange face, thus minimizing the possibility of breakage under excessive localized stressing. In the event there should be a sudden excessive surge of pressure applied by the feed material, the Belleville washers 34 may temporarily yield to permit some leakage, thus minimizing mechanical shock.

Figure 5:
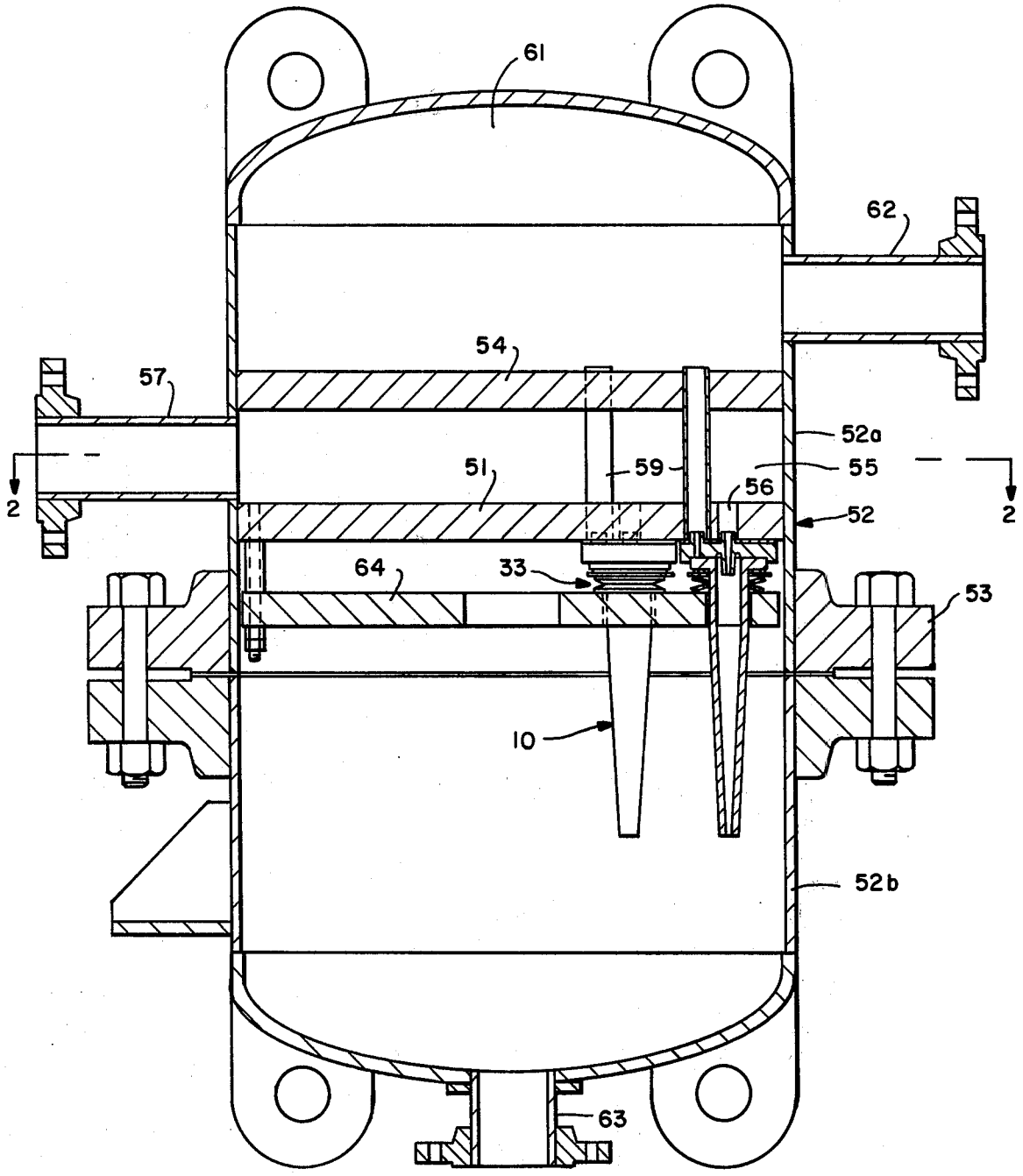
FIG. 5 is a side elevational view in section showing another embodiment of the invention.

The embodiment of FIG. 5 is similar to that of FIGS. 1–4 with respect to the mounting of the hydrocyclones, but in this instance a different structure is provided within the vessel section 11*a*. The mounting plate 51 corresponds to the mounting plate 13 of FIG. 1, and is within the pressure vessel 52 which has two sections 52*a* and 52*b* connected by the clamping flanges 53. Above the plate 51 there is a second partition plate 54 which extends diametrically across the pressure vessel and has sealed engagement with the same at its periphery. The space 55 between the plates 51 and 54 forms an overflow receiving space which is in communication with the ducts 56, which in turn communicate with the overflow passages 24 of the hydrocyclones. Overflow is discharged from space 55 through pipe 57. Pipes 59 communicate through the plate 51 and with the passages 22 of each hydrocyclone, and also extend through the plate 54 to communicate with the feed space 61 which receives feed material pumped through the pipe 62. Underflow material is collected in the lower pressure vessel section 52*b* and discharges through the pipe 63. The thrust member 64 is generally the same as in FIGS. 1–4, and the same applies to the Belleville washers 34.

Figure 6:
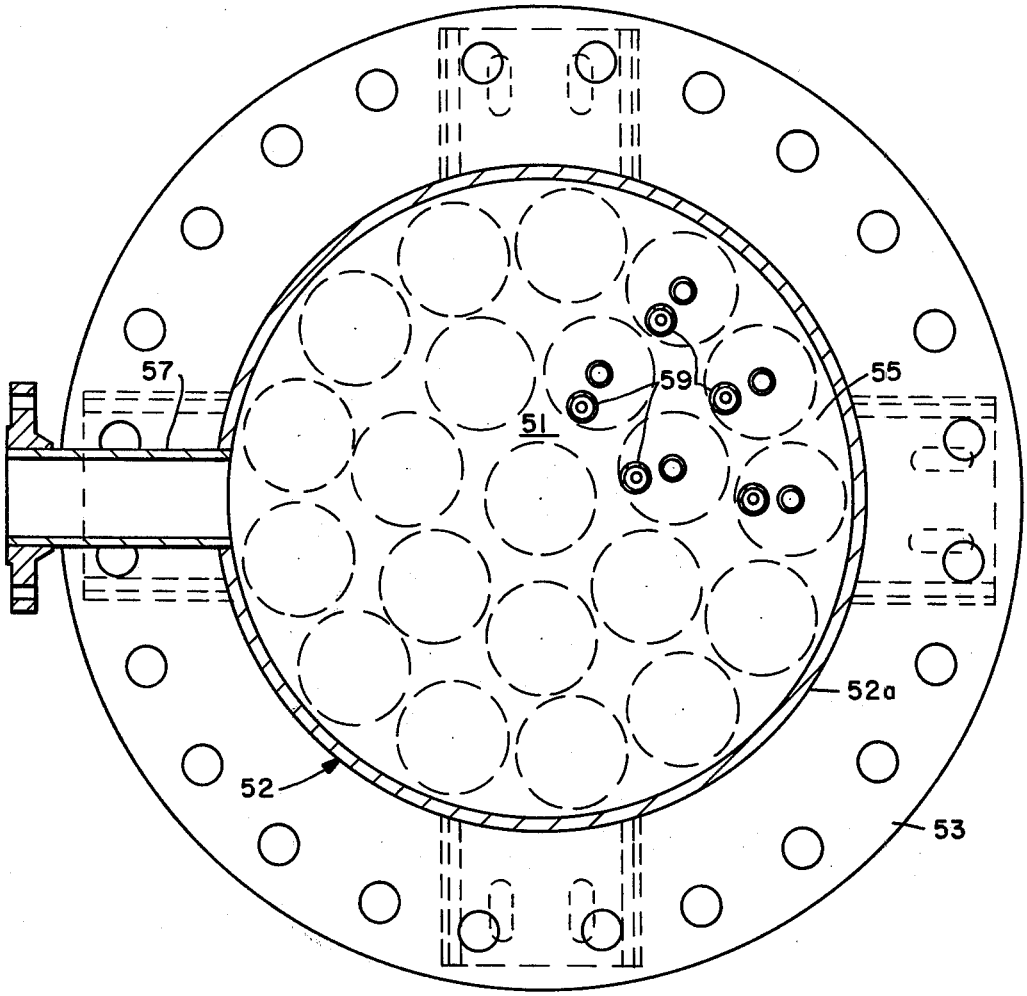
FIG. 6 is a cross-sectional view taken along the line 6—6 of FIG. 5.

FIG. 6 illustrates how a plurality of cyclones can be distributed within the pressure vessel of FIG. 5, the arrangement being such that the hydrocyclones are grouped in concentric circles, with a single hydrocyclone being at the center.

Figure 7:
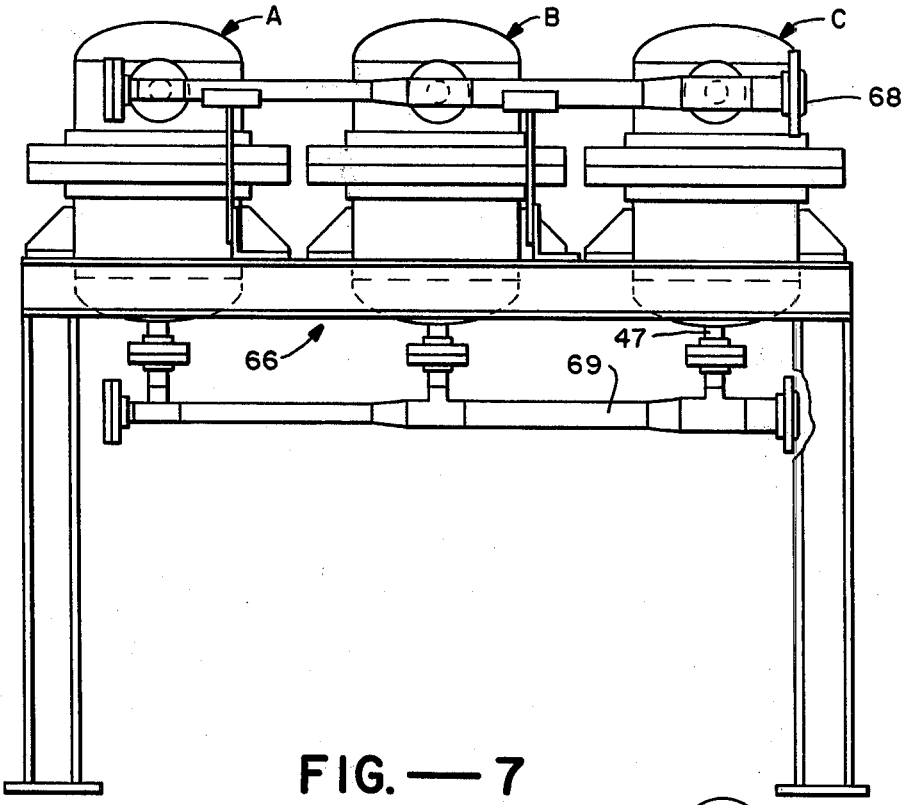
FIG. 7 is a side elevational view showing a plurality of units connected to common manifolding.
Figure 8:
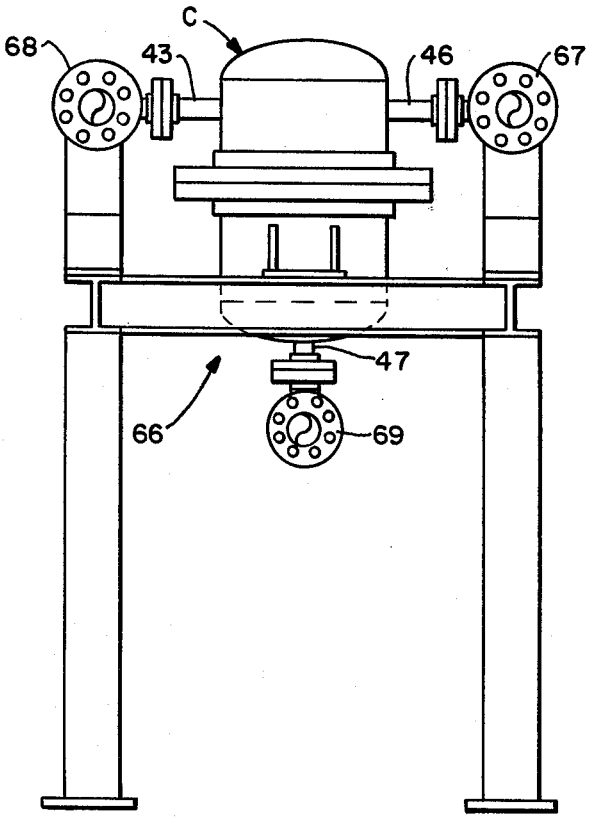
FIG. 8 is an end view of FIG. 7.

A plurality of the hydrocyclone assemblies can be readily connected to common manifolding. One manifolding arrangement, utilizing assemblies as shown in FIGS. 1–4, is shown in FIGS. 7 and 8. In this instance the hydrocyclone units A, B and C have their feed pipes 46 connected to the alongside inflow manifold pipes 67. Also the overflow discharge pipes 43 are connected to the adjacent manifold pipe 68. The underflow discharge pipes 47 from the pressure vessels all connect with the common manifold 69. It will be evident that this arrangement permits ready removal or replacement of a unit simply by uncoupling the pipe connections to the manifolds.

Figure 9:
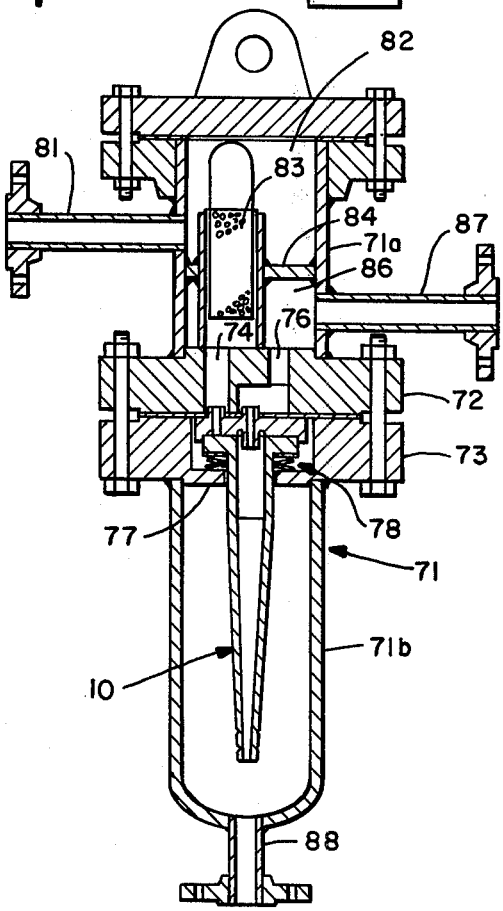
FIG. 9 is a side elevational view in section showing a single hydrocyclone within a pressure vessel also incorporating the present invention.

FIG. 9 shows an assembly which incorporates a single hydrocyclone. In this instance the pressure vessel vessel 71 has two sections 71*a* and 71*b* connected together by the coupling flanges 72 and 73. In place of the mounting plate 13 of FIG. 1, the coupling flange 72 is extended inwardly and provided with ducts 74 and 76 corresponding to the ducts 23 and 26 of FIG. 1. Instead of the separate abutment member 28 of FIGS. 1 and 3, the coupling flange 73 is extended inwardly to provide the annular portion 77. The Belleville washers 78 are interposed between the flange of the hydrocyclone body and the portion 77. The inflow or feed pipe 81 in this instance delivers the feed material into the receiving space 82, and from thence the material flows through the filter 83 and to the hydrocyclone involute passage through duct 74. The partition wall 84 provides a separate space 86 which receives overflow material and discharges it through the pipe 87. Underflow material is discharged into the lower pressure vessel section 71*b* and from thence through the pipe 88.

In all of the embodiments the feed receiving space or chamber within the pressure vessel is located above the hydrocyclones, assuming that the hydrocyclones are upright. This feature serves to largely avoid clogging difficulties experienced with prior assemblies previously described, which locate the feed chamber below the upper ends of the hydrocyclones and between plates engaging upper and lower portions of the same. With our assembly there is no tendency for solids of the feed to build up in the feed space or chamber and therefore no agglomerates find their way into the hydrocyclone separating chambers.

What is claimed is:

1. A hydrocyclone assembly suitable for high temperature applications comprising, when disposed in vertical position, an upright hydrocyclone body of ceramic material having an elongated separating chamber that is circular in section, the upper end of the body having an integral annular flange, the lower side of the flange presenting a flat annular surface area, the chamber having a portion adjacent the upper flanged end of the body for receiving feed material and an extended conical portion communicating at its lower apex end with an underflow discharge opening, an annular inlet head having the lower surface of the same in abutting engagement with the upper surface of the annular flange, a horizontal mounting plate having the lower surface of the same in abutting engagement with the upper surface of the inlet head, the inlet head having an overflow passage communicating axially with the interior of the chamber and an involute passage with its outlet communicating tangentially with the separating chamber, means on the upper side of the mounting plate forming separate fluid feed receiving and overflow receiving spaces, the mounting plate having one duct for establishing fluid communication between the feed receiving space and the inlet end of the involute passage and having another duct for establishing fluid communication between the overflow receiving space and the overflow passage, sealing means interposed between the upper surface of the head and the lower surface of the mounting plate, and means for yieldably clamping the flanged end of the body and the inlet head together and against the plate, said means including a horizontal thrust abutment member disposed below said mounting plate and surrounding that portion of the body below and adjacent said said flange, and partially compressed annular spring means of the distorted washer type interposed between the upper surface of the abutment member and the lower flat annular surface area of the flange, said last named means serving to apply clamping force that is evenly distributed over said annular flange and forming the yieldable means for supporting the hydrocyclone body and for clamping the flanged end of the body and the inlet head together and against the mounting plate.

2. A hydrocyclone assembly as in claim 1 in which the abutment member is adjustable relative to the mounting plate to adjust the degree of compression and the thrust of the spring means.

3. A hydrocyclone assembly as in claim 1 in which the spring means includes at least one spring washer of the Belleville type, and in which flat washers are disposed between the spring means and said annular area of the flange.

4. A hydrocyclone assembly suitable for high temperature applications comprising, when disposed in vertical position, a closed pressure vessel formed of upper and lower connected sections, a plurality of vertically disposed hydrocyclones disposed within the vessel, each hydrocyclone comprising a body of ceramic material having an elongated separating chamber that is circular in section, the upper end of each body having an integral annular flange, the lower side of each flange being formed to provide a flat annular surface area, the chamber having a portion at the flanged end of the body for receiving fluid feed material, each body having an underflow discharge opening at its conical end, each hydrocyclone also including an inlet head having a lower flat surface of the same in abutting engagement with the upper surface of the flanged end of the body, a mounting plate having the lower surface of the same in abutting engagement with the inlet head of each of the hydrocyclones, said plate extending across the interior of the pressure vessel and having its perimeter secured to one of the vessel sections adjacent the connection between the sections, each inlet head having an overflow passage communicating axially with the separating chamber of the corresponding ceramic body and an involute passage having its outlet end communicating tangentially with the same separating chamber, means separating the space in the upper vessel section thereby forming separate feed receiving and overflow receiving spaces, the mounting plate having a first set of ducts for establishing fluid communication between the feed receiving space and the inlet of each of the involute passages and having a second set of ducts for establishing fluid communication between the overflow receiving space and the overflow passage of each of the hydrocyclones, and means for yieldably clamping each hydrocyclone body together with the corresponding inlet head against the plate, said means including a thrust abutment plate spaced from one side of the mounting plate and having openings each dimensioned to accommodate the body of the hydrocyclone and partially compressed annular spring means interposed between the abutment member and the lower surface of the flange of each of the bodies and serving to apply thrust that is uniformly distributed to the associated flange, and external feed and overflow discharge piping communicating with said spaces.

5. A hydrocyclone assembly as in claim 4 in which said feed receiving and overflow receiving spaces of said upper vessel section are formed by outer and inner concentric dome like vessel sections, each of the vessel sections having sealed engagement with the mounting plate, the space within the inner vessel section being in communication with said first set of ducts and forming the feed receiving space, and the space between said vessel sections being in communication with the second set of ducts in the mounting plate and forming said overflow receiving space, the lower section of the pressure vessel forming an underflow receiving space for all of the hydrocyclones.

6. A hydrocyclone assembly as in claim 4 in which said feed receiving and overflow receiving spaces are formed by a partition wall extending across said upper vessel section in spaced parallel relationship to the mounting plate, the space above the partition wall forming the fluid receiving space and the space between the partition wall and the mounting plate forming the overflow receiving space, means serving to establish communication between the feed receiving space and the inlet of the involute passage of each of the hydrocyclones, and means forming fluid communication between the overflow receiving space and each of the overflow passages of each hydrocyclone.

* * * * *